US005197621A

United States Patent [19]

Bartl et al.

[11] Patent Number: 5,197,621

[45] Date of Patent: Mar. 30, 1993

[54] SCREW CAP MADE OF PLASTICS MATERIAL

[75] Inventors: Franz T. Bartl, Allschwil; Hans-Werner Breuer, Laufen, both of Switzerland

[73] Assignee: Crown Cork AG, Reinach, Switzerland

[21] Appl. No.: 598,709

[22] PCT Filed: Mar. 9, 1990

[86] PCT No.: PCT/CH90/00060

§ 371 Date: Oct. 30, 1990

§ 102(e) Date: Oct. 30, 1990

[87] PCT Pub. No.: WO90/10581

PCT Pub. Date: Sep. 20, 1990

[30] Foreign Application Priority Data

May 17, 1989 [CH] Switzerland ..... 1841/89

[51] Int. Cl.[5] ..... B65D 41/04

[52] U.S. Cl. ..... 215/331; 215/329; 215/350; 215/351; 220/296

[58] Field of Search ..... 215/331, 330, 351, 350, 215/344, 337, 329; 220/296

[56] References Cited

U.S. PATENT DOCUMENTS

| | | | |
|---|---|---|---|
| 1,727,938 | 9/1929 | Rantsch | 220/296 |
| 2,904,837 | 9/1959 | Crabbe | 215/329 X |
| 3,182,843 | 5/1965 | Foye | 215/337 X |
| 3,339,773 | 9/1967 | Stull | 215/329 |
| 3,841,514 | 10/1974 | Montgomery et al. | 215/329 X |
| 4,093,096 | 6/1978 | Augros | 215/331 X |
| 4,177,906 | 12/1979 | Von Hagel | 215/329 X |
| 4,476,987 | 10/1984 | Nolan | 215/329 X |
| 4,591,063 | 5/1986 | Geiger | 215/331 X |
| 4,651,886 | 3/1987 | Stull | 215/329 |
| 4,723,685 | 2/1988 | Fillmore et al. | 215/329 X |

*Primary Examiner*—Allan N. Shoap
*Assistant Examiner*—Paul A. Schwarz
*Attorney, Agent, or Firm*—Shoemaker and Mattare, Ltd.

[57] ABSTRACT

A screw cap comprises an internal screw thread and a braking element for engaging the lead end of the external screw thread on a container for which the cap is intended. When the cap is applied to the container, the braking element progressively retards the screwing movement.

12 Claims, 4 Drawing Sheets

SCREW CAP MADE OF PLASTICS MATERIAL

BACKGROUND OF THE INVENTION

The invention concerns a screw cap made from plastic according to the preamble of claim 1. These types of screw caps are manufactured in very large numbers by the injection molding process and are used to close off containers of the most varied kinds. Screw caps made of plastic have found an application mainly in the refreshment drinks branch, where the screw caps are screwed automatically onto the filled bottles on rapidly moving filling lines.

A problem with conventional screw caps occurs in that they must be screwed on with a definite application of torque, in order to ensure a sealed fit. Thereby, the screw movement is normally limited, since the bottle opening comes into contact with the base of the screw cap. The danger thus exists that the cap is screwed on with excessive torque, so that subsequently it can hardly be manually unscrewed. Overwinding of the threads can also occur in certain cases, since the bottle openings, especially in the case of glass bottles, can exhibit large variations of tolerance.

SUMMARY OF THE INVENTION

It is therefore a purpose of the invention to design the screw caps of the type mentioned in the introduction so that the screw-on movement is no longer limited, or no longer exclusively limited, by the base of the screw cap, and so that screwing on of the cap with too great a torque onto the container opening can be prevented. This purpose is achieved, according to the invention, with a screw cap exhibiting the characteristics of claim 1.

The brake element, arranged in the region of the helical line of the external thread of the container, arrests the screwing on procedure without the opening of the container, with full torque application, at the same time coming into contact with the screw cap base. When the external thread makes contact with the brake element, the screw-on force is transformed into a radial force component, since the external thread has a tendency to override the brake element and with that to be radially displaced outwards.

Depending on the design of the brake element and the elastic properties of the material, the rest position of the screw cap can be retarded. With that, it is especially advantageous if the brake element possesses an override surface which runs approximately parallel to the middle axis of the screw cap. Apart from that, the override surface can be inclined at an angle running through the middle axis of the screw cap. The override surface is thus formed like a ramp, onto which the external thread ascends with increasing radial tension.

The brake element can be integrated into the internal thread or it can be formed separately from the internal thread. The braking element can also possess a profile which is formed as a thread flank for the internal thread. The brake element obtains an additional function in this way. This function can be extended if the screw cap possesses one or more support ribs near the screw cap base to hold an inserted sealing disk in place, and if the braking element possesses a profile that runs in the plane of the support ribs. Thus, a part of the sealing disk rests upon the brake element.

The previously mentioned multi-function of the brake element can thus be especially easily achieved if, in plan, it possesses the shape of a wedge, which extends through a sector of at least 90 degrees. With that, the override surface is arranged on the wide end of the wedge which must possess a definite minimum width in order that the start of the external thread always strikes the brake element.

BRIEF DESCRIPTION OF THE DRAWINGS

A version of the invention is depicted in the drawings, and is more exactly described in the following section.

DESCRIPTION OF THE PREFERRED EMBODIMENT

Figure 1:
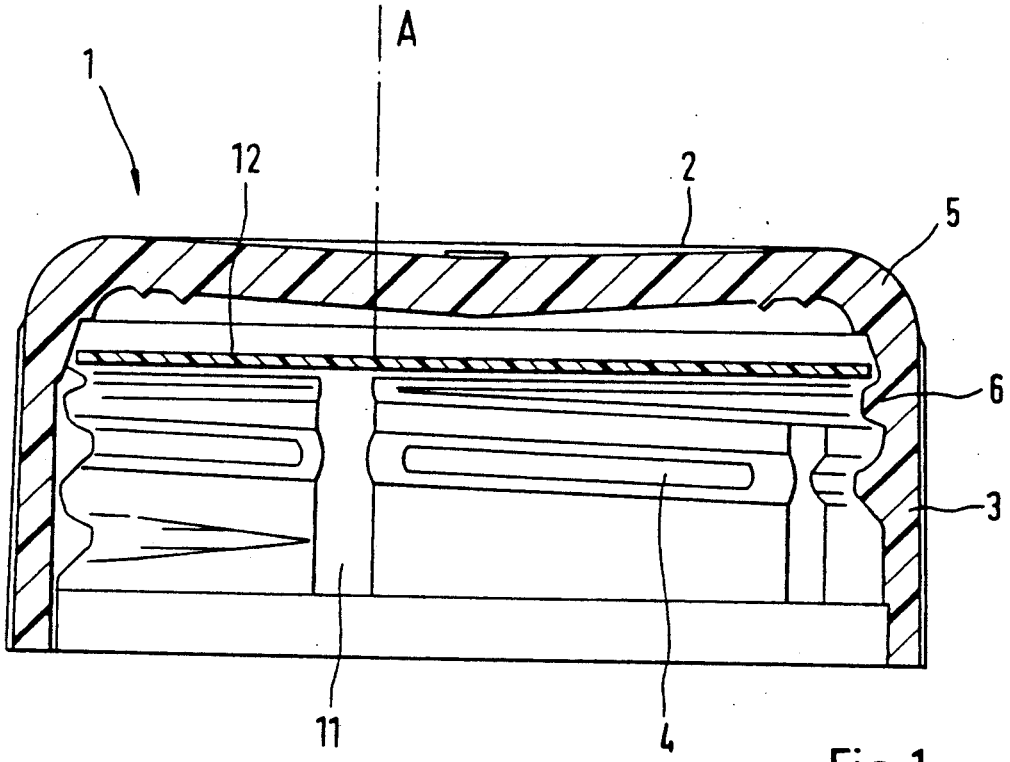
FIG. 1 is a cross-section through a screw cap according to the invention.

A screw cap 1 is depicted in FIG. 1 which comprises in principle a cap base 2 and an adjacent, somewhat cylindrical cap wall 3. The screw cap is rounded off in the transitional area 5 between the cap wall 3 and the cap base 2. The internal thread 4 is arranged on the inside of the screw cap wall, which possesses approximately 1½ turns. These are interrupted by air release slots 11, which allow a rapid release of pressure when the cap is unscrewed if an over-pressure exists within the container.

Support ribs 13 are arranged on the cap wall 3 near the screw cap base 2 or in the transitional area 5. These support ribs hold a sealing disk 12, made from an elastic material. As can be observed in FIG. 2, this sealing disk is displaced upwards when the cap is screwed on, whereby it comes to lie as a seal around the area of the opening.

Figure 4:
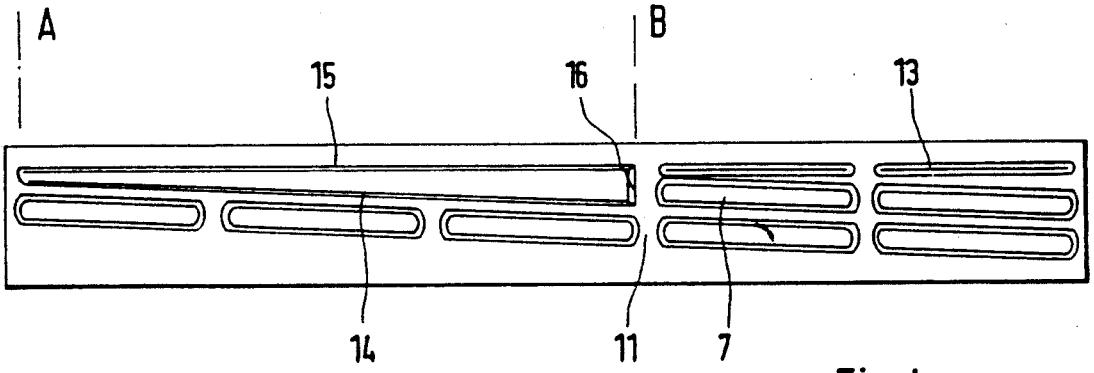
FIG. 4 is a variation of the screw cap inner wall on a slightly smaller scale.

A brake element 15 is arranged at the end 7 of the internal thread 4, which is formed slightly less deeply than the flanks of the internal thread 4. As shown in FIG. 4, the brake element is formed in plan as an extended wedge. It is not connected to the thread end 7, but starts immediately after a pressure release slot 11. The brake element extends through the sector A to B, through slightly more than 180 degrees.

Figure 3:
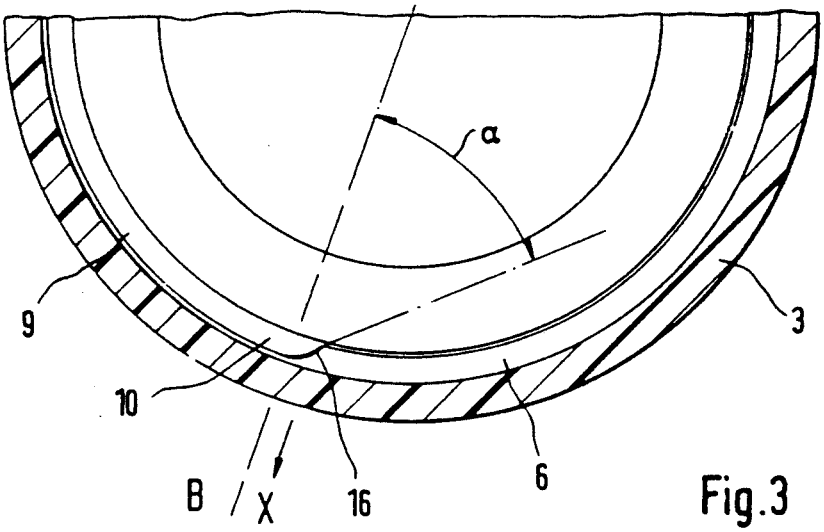
FIG. 3 is a part-cross-section through the closure arrangement according to FIG. 2.

The brake element has an override surface 16 which is inclined through the angle Alpha to a plane running through the middle axis of the screw cap, as can be seen in FIG. 3. The override surface otherwise runs parallel, however, to the middle axis, so that when the start of the thread 10 overrides it a force component in the direction X ensues.

The brake element possesses a profile 14 which is inclined in the helix angle of the internal thread 4 and which in practice performs the function of a thread flank. On the other hand the brake element also has another profile 15, which lies in the plane of the support ribs 13. Thus the profile 15 forms a continuation of the support ribs 13, on which the sealing disk 12 lies. The support ribs 13 are interrupted at the pressure release slots 11, to ensure optimal pressure release. It would also be conceivable to provide a single, continuous, support rib.

The wedge shaped brake element 6 depicted in FIG. 4 has evidently a multi-function, in that it serves as a mechanical stop for the external thread, as a thread flank, and as a protection shoulder for the sealing disk. This configuration is also particularly advantageous from the technical point of view of injection casting and tooling, and allows itself to distort easily.

Evidently the brake element 6 must not of necessity possess the wedge shape shown in this version. Closure caps with alternative sealing systems can dispense with the profile 15 or adopt another relative position, without problems. The configuration of the brake element must in every case be such that it always lies in the region of the helical line for the external thread.

Figure 5:
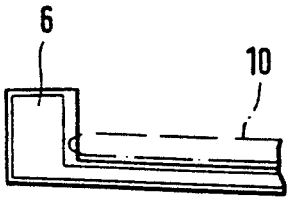
FIG. 5 and FIG. 6 are plan views of a modified version of the brake element.
Figure 6:
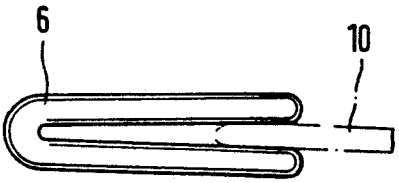

The FIGS. 5 and 6 show alternative configurations of the brake element. With that, the radial depth can be approximately the same as with the version depicted according to the FIGS. 1 to 4.

According to FIG. 5, the brake element 6 is formed as one part, connected with the end 7 of the internal thread and extends like a vane into the helical line of the external thread. The start 10 of the external thread likewise strikes the brake element head-on. In the case of the version according to FIG. 6, the brake element is U-shaped and arranged fully separately. The lower limb could, however, theoretically form the continuation of the internal thread. The start 10 of the external thread does not strike head-on here, but comes into contact with both surfaces of the braking element.

Figure 7:
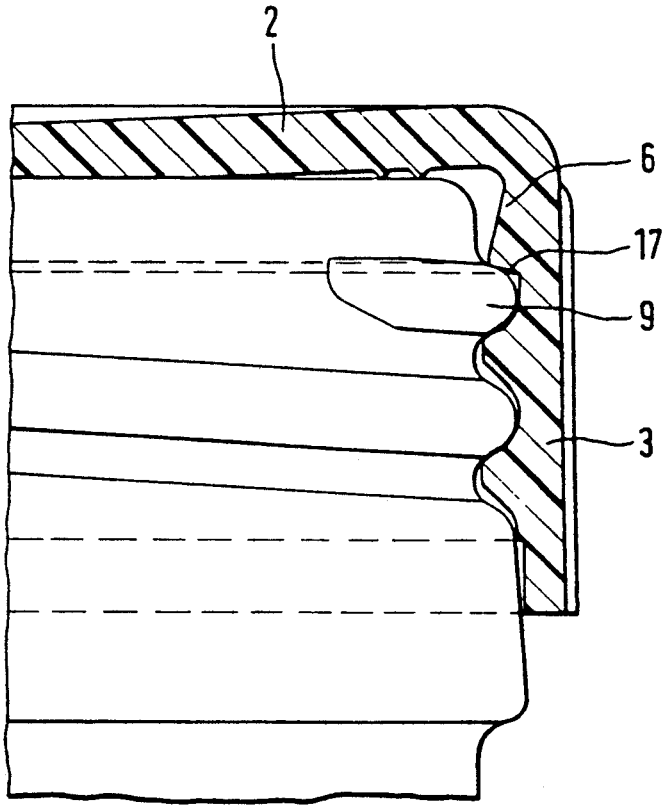
FIG. 7 depicts a brake element formed as a surrounding rib.

In the case of the version depicted in FIG. 7, the brake element 6 is formed as a rib, which can extend over the entire circumference of the cap wall 3, or also only through a certain sector. When the cap is screwed on, the underside 17 of the rib makes contact with the start of the external thread 9. As opposed to the previously described radially acting override surface 16, the underside 17 exerts an axial braking force. The rib could also serve, for example, as a reinforcement of the transitional area of cap base 2 and cap wall 3.

Figure 8:
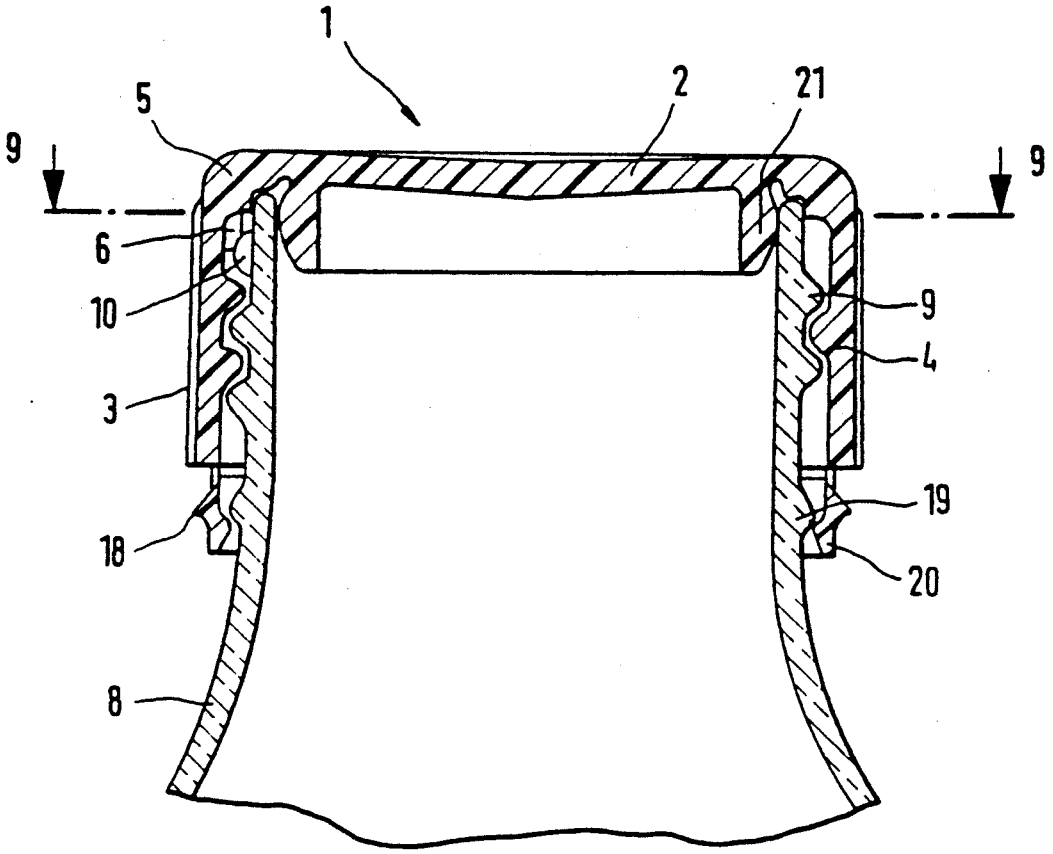
FIG. 8 shows a modified version of a screw cap with a removeable guarantee strip.
Figure 9:
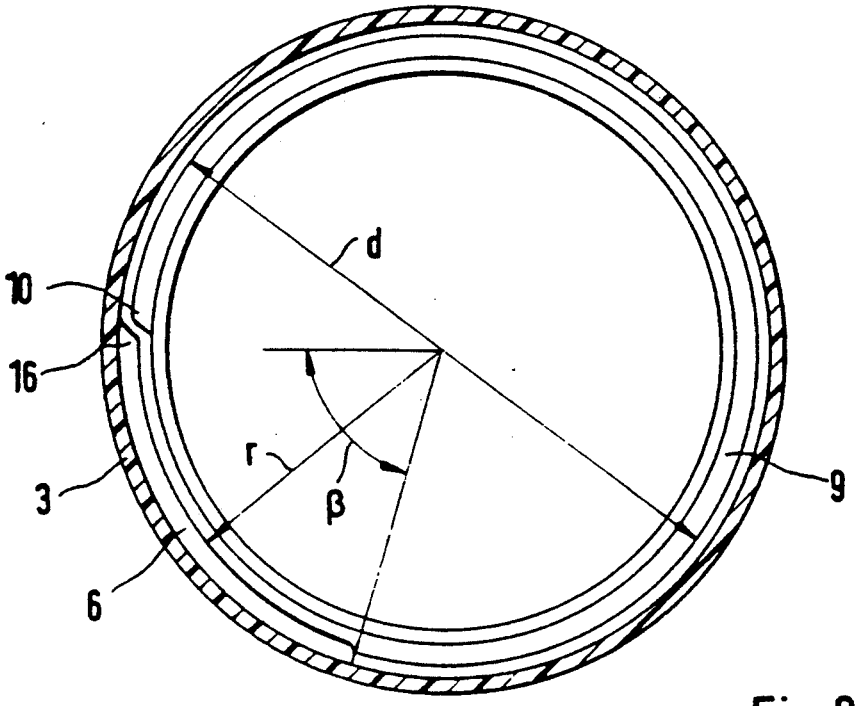
FIG. 9 is a section through the plane 9—9 in FIG. 8.

An alternative example of a screw cap according to the invention is depicted in FIGS. 8 and 9. In place of an inserted sealing disk, the screw cap 1 possesses an olive formed inner seal 21 on the screw cap base 2, which is pressed into the bottle opening when the cap is screwed on. A removeable guarantee strip 18 is arranged on the lower edge of the screw cap which is provided with at least one retention element. A surrounding bead 19 is provided at the container opening 8, under which the retention element 20 engages when the screw cap is screwed on for the first time. When the cap is unscrewed for the first time, the guarantee strip is either totally or partly separated from the lower edge of the cap, so that the initial opening of the screw cap will be indicated. This type of guarantee strip is already known to the specialist, whereby the retention element can possess different shapes, for example cams, tongues, beads etc.

The brake element 6 is now particularly advantageously so arranged that when the cap is screwed on for the first time the braking effect will take effect immediately after the engagement of the retention element 20 beneath the bead 19. Depending on the nature of the retention element, it can be significant for the function of the guarantee strip if the guarantee strip does not exceed a definite relative position to the bead 19. The brake element 6 could, however, be so arranged that the braking effect is already applied before the engagement of the retention element, and that the engagement position will just have been reached when the braking procedure is complete, therefore when the screw cap is at rest.

In the version according to FIGS. 8 and 9 the braking element comprises a rib or a thickening in the transitional area 5 of the cap. The rib extends through an angle Beta of approximately 75 degrees. The inner radius r of the rib is less than half of the diameter d of the external thread 9. With that, the start 10 of the external thread strikes the override surface 16, presses the rib 6 radially outwards and causes the screw cap to come to rest through higher friction after a definite arc length.

Figure 2:
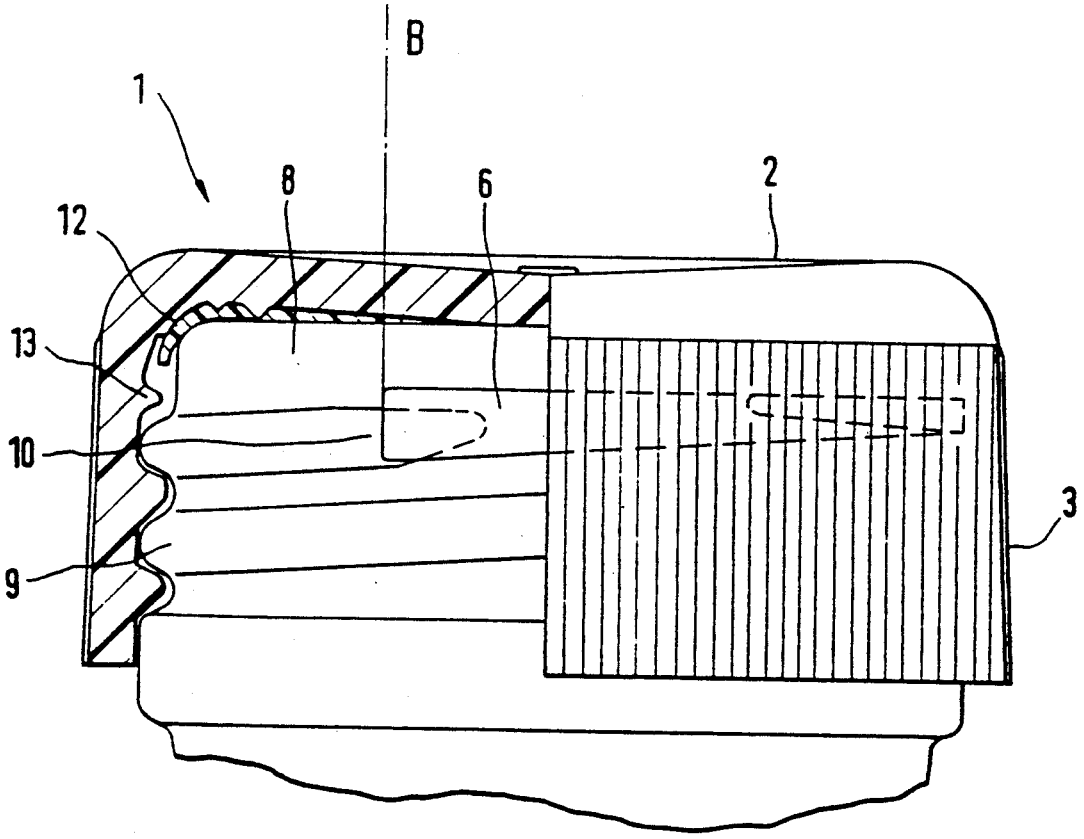
FIG. 2 is a cross-section through a screw cap, screwed onto a container opening according to FIG. 1.

Naturally the screw cap according to FIGS. 1 to 3 can be provided with a guarantee strip according to FIG. 8.

We claim:

1. A screw cap made from the plastic material, for application to a container neck having an external helical thread, said screw cap comprising a base and an annular cap wall extending from the periphery of the base, said wall having both an internal screw thread for engaging the external screw thread on the container and a brake element on the inside of the annular wall, adjacent the base, said brake element lying at least partly in the path of the external screw thread, and having an override ramp surface which is inclined relative to the path of the external screw thread, whereby the brake element ascends over the helical thread on the bottle neck, displacing a portion of the annular wall of the cap radially outward, and thus progressively retards cap movement, without abruptly halting such movement, when the cap is screwed onto the container.

2. A screw cap according to claim 1, wherein the cap has a central longitudinal axis, and the override surface extends substantially parallel to the central axis.

3. A screw cap according to claim 2, wherein the override surface is inclined with respect to a radial plane of the cap.

4. A screw cap according to claim 1, wherein the brake element is integral with the internal thread of the cap.

5. A screw cap according to claim 1, wherein the brake element is formed separately from the internal thread of the cap.

6. A screw cap according to claim 1, wherein the brake element has a profile formed as a thread flank for the internal thread.

7. A screw cap according to claim 1, wherein the brake element, when viewed in a direction parallel to the longitudinal axis of the cap, has a wedge profile, extending through an arc of at least ninety degrees.

8. A screw cap according to claim 1, further comprising at least one support rib near the base of the cap for retaining an inserted sealing disk, and the brake element has a profile that runs in the plane of the support rib.

9. A screw cap according to claim 8, wherein the brake element, when viewed in a direction parallel to the longitudinal axis of the cap, has a wedge profile, extending through an arc of at least ninety degrees.

10. A screw cap according to claim 1, wherein the brake element is a rib extending over an arc of the annular wall.

11. A screw cap according to claim 10, wherein the rib extends over the entire circumference of the annular wall.

12. A screw cap according to claim 1, further comprising a guarantee strip on its lower edge, said strip having at least one retention member on its inside, for gripping an annular protrusion on the container from below, and the brake element is arranged so as to begin its braking effect immediately after the retention element is in engagement below the annular protrusion.

* * * * *